US007486242B2

(12) United States Patent
Gala Gala et al.

(10) Patent No.: US 7,486,242 B2
(45) Date of Patent: Feb. 3, 2009

(54) MULTIBAND ANTENNA FOR HANDHELD TERMINAL

(75) Inventors: David Gala Gala, San Cugat del Valles (ES); Carles Puente Baliarda, San Cugat del Valles (ES); Jordi Soler Castany, San Cugat del Valles (ES)

(73) Assignee: Fractus, S.A., Barcelona (ES)

( * ) Notice: Subject to any disclaimer, the term of this patent is extended or adjusted under 35 U.S.C. 154(b) by 208 days.

(21) Appl. No.: 11/021,597

(22) Filed: Dec. 23, 2004

(65) Prior Publication Data

US 2005/0259013 A1 Nov. 24, 2005

(51) Int. Cl.
*H01Q 1/24* (2006.01)

(52) U.S. Cl. ..... 343/702; 343/846

(58) Field of Classification Search ..... 343/700 MS, 343/702, 895, 846

See application file for complete search history.

(56) References Cited

U.S. PATENT DOCUMENTS

| | | | | |
|---|---|---|---|---|
| 4,608,572 | A * | 8/1986 | Blakney et al. | 343/792.5 |
| 4,907,006 | A | 3/1990 | Nishikawa | |
| 5,262,792 | A | 11/1993 | Egashira | |
| 5,497,167 | A | 3/1996 | Luoma | |
| 5,646,637 | A | 7/1997 | Miller | |
| 5,703,600 | A | 12/1997 | Burrell | |
| 5,903,239 | A | 5/1999 | Takahashi | |
| 5,903,822 | A | 5/1999 | Sekine et al. | |
| 6,002,367 | A | 12/1999 | Engblom et al. | |
| 6,104,349 | A | 8/2000 | Cohen | |
| 6,140,975 | A | 10/2000 | Cohen | |
| 6,218,992 | B1 | 4/2001 | Sadler | |
| 6,239,765 | B1 | 5/2001 | Johnson et al. | |
| 6,285,326 | B1 | 9/2001 | Diximus | |
| 6,307,511 | B1 | 10/2001 | Ying et al. | |
| 6,314,273 | B1 | 11/2001 | Matsuda | |
| 6,359,589 | B1 | 3/2002 | Bae | |

(Continued)

FOREIGN PATENT DOCUMENTS

CA 2416437 A1 1/2002

(Continued)

OTHER PUBLICATIONS

X. H. Yang et al., "Multifrequency Operation Technique for Aperture Coupled Microstrip Antennas", IEEE, 1994, pp. 1198-1201.

(Continued)

*Primary Examiner*—Michael C Wimer
(74) *Attorney, Agent, or Firm*—Winstead PC

(57) ABSTRACT

The present invention relates generally to a new family of antennas with a multiband behaviour and a reduced size. The general configuration of the antenna consists of a multilevel structure which provides the multiband behaviour, combined with a multilevel and/or space-filling ground-plane. The multilevel structure consists of two arms of different length that follow a winding parallel path spaced by a winding parallel gap (parallel to the arms) with a substantially similar shape as each of said arms, that is, with a similar winding path as the arms. The resulting antenna covers the major current and future wireless services, opening this way a wide range of possibilities in the design of universal, multi-purpose, wireless terminals and devices.

21 Claims, 11 Drawing Sheets

U.S. PATENT DOCUMENTS

| | | | | |
|---|---|---|---|---|
| 6,366,243 | B1 | 4/2002 | Isohätälä | |
| 6,377,217 | B1 | 4/2002 | Zhu | |
| 6,388,620 | B1 | 5/2002 | Bhattacharyya | |
| 6,407,710 | B2 | 6/2002 | Keilen | |
| 6,462,710 | B1 | 10/2002 | Carson | |
| 6,466,170 | B2 | 10/2002 | Zhou | |
| 6,466,176 | B1 | 10/2002 | Maoz | |
| 6,476,766 | B1 | 11/2002 | Cohen | |
| 6,483,462 | B2 | 11/2002 | Weinberger et al. | |
| 6,552,686 | B2 | 4/2003 | Ollikainen et al. | |
| 6,606,062 | B2 | 8/2003 | Ngounou Kouam et al. | |
| 6,614,400 | B2 | 9/2003 | Egorov | |
| 6,650,294 | B2 | 11/2003 | Ying et al. | |
| 6,650,298 | B2 * | 11/2003 | Abbasi et al. | 343/702 |
| 6,727,857 | B2 | 4/2004 | Mikkola et al. | |
| 6,741,210 | B2 | 5/2004 | Brachat | |
| 6,759,989 | B2 | 7/2004 | Tarvas et al. | |
| 6,791,498 | B2 | 9/2004 | Boyle et al. | |
| 6,806,834 | B2 | 10/2004 | Yoon | |
| 6,906,667 | B1 | 6/2005 | Poilasne | |
| 7,019,695 | B2 | 3/2006 | Cohen | |
| 2001/0033250 | A1 | 10/2001 | Keilen et al. | |
| 2002/0044090 | A1 | 4/2002 | Bahr et al. | |
| 2002/0140615 | A1 | 10/2002 | Carles et al. | |
| 2002/0177416 | A1 | 11/2002 | Boyle | |
| 2004/0027295 | A1 | 2/2004 | Huber et al. | |
| 2004/0058723 | A1 | 3/2004 | Mikkola | |
| 2004/0155823 | A1 | 8/2004 | Kossiavas | |
| 2005/0237251 | A1 | 10/2005 | Boyle | |

FOREIGN PATENT DOCUMENTS

| | | | |
|---|---|---|---|
| EP | 0688040 | A2 | 12/1995 |
| EP | 0932219 | A2 | 7/1999 |
| EP | 0997974 | A1 | 5/2000 |
| EP | 1 024 552 | | 8/2000 |
| EP | 1 026 774 | | 8/2000 |
| EP | 1 128 466 | | 8/2001 |
| EP | 1 148 581 | | 10/2001 |
| EP | 1195847 | A2 | 4/2002 |
| EP | 1304765 | A2 | 4/2003 |
| EP | 1401050 | A1 | 3/2004 |
| JP | 10261914 | A | 9/1998 |
| WO | 9627219 | A1 | 9/1996 |
| WO | WO-97/06578 | | 2/1997 |
| WO | 00/30211 | | 5/2000 |
| WO | WO-00/52784 | | 9/2000 |
| WO | WO-00/57511 | | 9/2000 |
| WO | WO-01/08257 | | 2/2001 |
| WO | 0122528 | A1 | 3/2001 |
| WO | 0126182 | A1 | 4/2001 |
| WO | WO-01/39321 | | 5/2001 |
| WO | WO-01/47056 | | 6/2001 |
| WO | 0154225 | A1 | 7/2001 |
| WO | WO-01/54225 | | 7/2001 |
| WO | WO-02/01668 | | 1/2002 |
| WO | 0229929 | A2 | 4/2002 |
| WO | 02095869 | A1 | 11/2002 |
| WO | WO-03/003544 | | 1/2003 |
| WO | WO-03/023900 | | 3/2003 |
| WO | 03034544 | A1 | 4/2003 |
| WO | 2004001894 | A1 | 12/2003 |
| WO | 2004102744 | A1 | 11/2004 |

OTHER PUBLICATIONS

Gschwendtner et al. Multi-service dual-mode spiral antenna for conformal integration into vehicles roofs, Antennas and Propagation Society International Symposium, 2000, vol. 3.

Lin et al. A dual-frequency microstrip-line-fed printed slot antenna, Microwave and Optical Technology Letters, Mar. 2001, vol. 26, No. 6.

Chiou et al. Designs of compact microstrip antennas with a slotted ground plane, Antennas and Propagation Society International Symposium, 2001, vol. 2.

Huynh et al., Ground plane effects on PIFA performance, Virginia Tech Antenna Group, APS/URSI conference, Jul. 2000.

Volski et al. Influence of the shape the ground plane on the radiation parameters of planar antennas, Microwaves, Antennas and Propagation, IEE Proceedings, Aug. 2003, vol. 150.

Natarajan et al. Effect of ground plane shape on microstrip antenna performance for cell-phone applications, Antennas and Propagation Society International Symposium, 2001. vol. 3.

Anguera et al. Enhancing the performance of handset antennas by means of groundplane design, IEEE International Workshop on Antenna Technology Small Antennas and Novel Metamaterials, 2006.

Huang, Cross-slot-coupled microstrip antenna and dielectric resonator antenna for circular polarization, IEEE Transactions on Antennas and Propagation, Apr. 1999, vol. 47, No. 4.

Cabedo, Antennas multibanda para aplicaciones 2G, 3G, WIFI, WLAN y Bluetooth en terminales móviles de nueva generación. Universitat Ramón Llull, Fractus, Nov. 2006.

Moretti, P. Numerical investigation of vertical contacless transitions for multilayer RF circuits, Microwave Symposium Digest, 2001.

Remski , R. et al, Frequency selective surfaces, Ansoft Corporation, Sep. 2001.

Parker , E. A., The gentleman's guide to frequency selective surfaces, 17th Q.M.W. Antenna Symposium, Apr. 1991.

* cited by examiner

FIG 1A
1 (Prior Art)
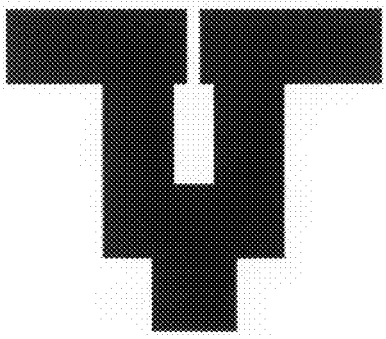
FIG 1B
2 (Prior Art)
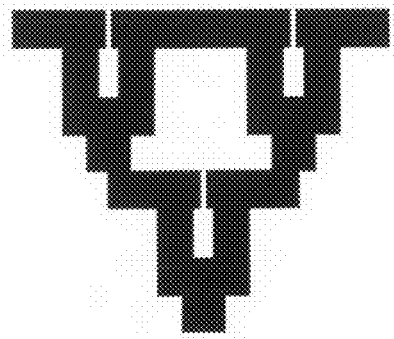
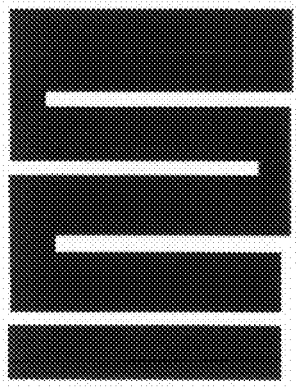
FIG 1C
3 (Prior Art)
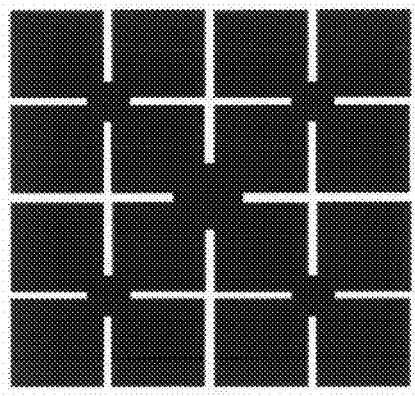
FIG 1D
4 (Prior Art)

3 (Prior Art)

3 (Prior Art)

FIG 5A
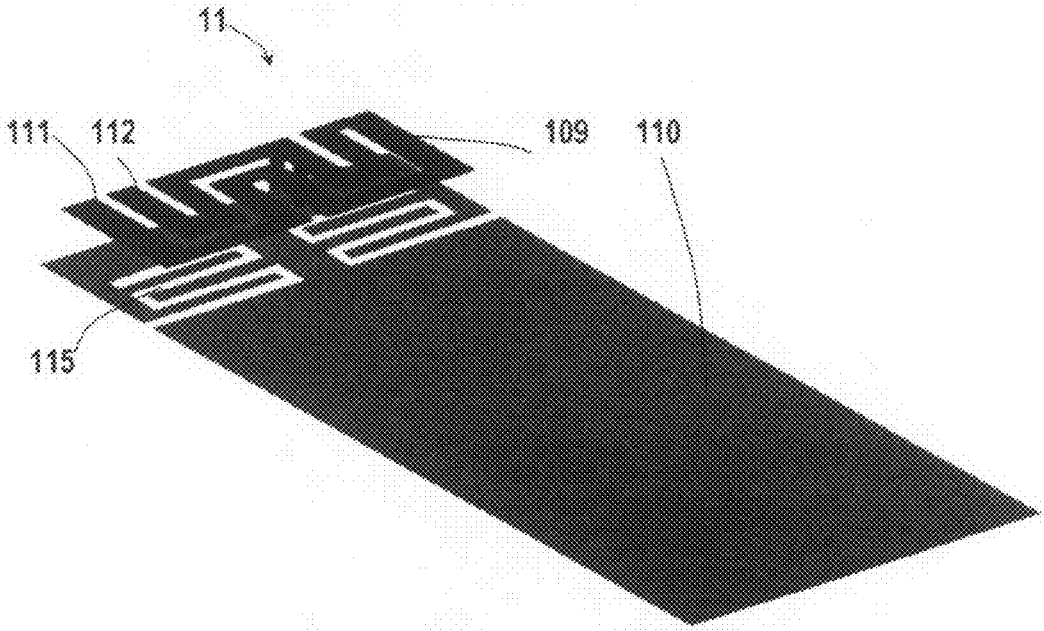
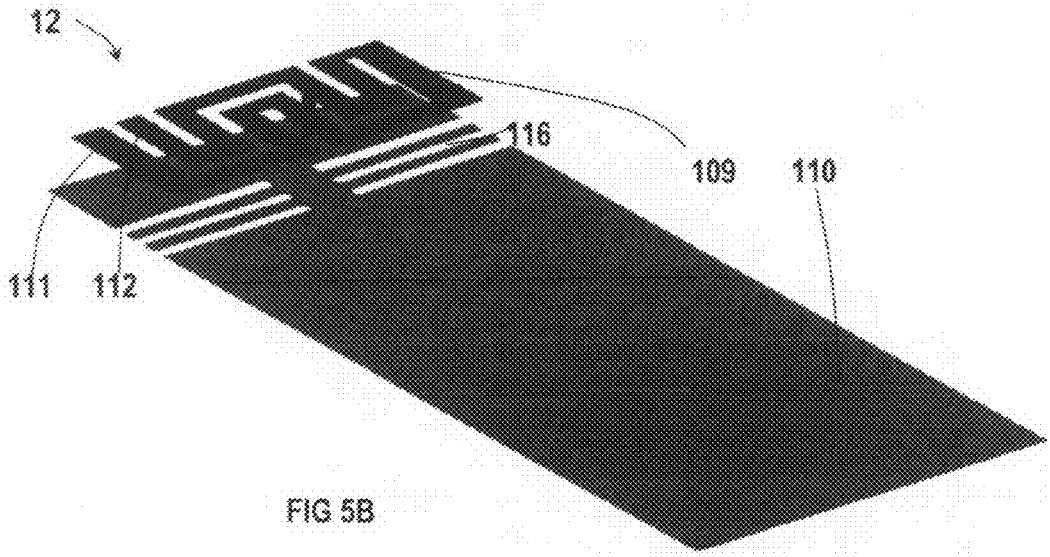
FIG 5B

MULTIBAND ANTENNA FOR HANDHELD TERMINAL

OBJECT AND BACKGROUND OF THE INVENTION

The present invention relates generally to a new family of antennas with a multiband behaviour and a reduced size. The general configuration of the antenna consists of a multilevel structure which provides the multiband behaviour, combined with a multilevel and/or space-filling ground-plane. A description on Multilevel Antennas can be found in Patent Publication No. WO01/22528. A description on several multilevel and space-filling ground-planes is disclosed in Patent Application PCT/EP01/10589. In the present invention, a modification of said multilevel structure is introduced such that the frequency bands of the antenna can be tuned simultaneously to the main existing wireless services. In particular, the modification consists of splitting the multilevel structure in two arms of different length that follow a winding parallel path spaced by a winding parallel gap (parallel to the arms) with a substantially similar shape as each of said arms, that is, with a similar winding path as the arms. Also, when the multilevel antenna structure is combined with a multilevel and/or space-filling ground-plane, the overall performance of the antenna is enhanced, increasing the bandwidth and efficiency of the whole antenna package. Due to the small size, high efficiency and broad band behaviour of the antenna, it is especially suitable for, but not limited to, the use in small handheld terminals such as cellular phones, PDAs or palmtop computers.

Although publications WO01/22528 and WO01/54225 disclose some general configurations for multiband and miniature antennas, an improvement in terms of size, bandwidth, and efficiency is obtained in some applications when said multilevel antennas are set according to the present invention. Such an improvement is achieved mainly due to the particular two-arm multilevel geometry of the antenna, used in conjunction with the design of the ground-plane and the interaction of both. Also, in some embodiments the antenna features a single feeding point and no connection to the ground-plane is required, which introduces a significant advantage in terms of manufacturing cost and mechanical simplicity.

A multilevel structure for an antenna device, as it is known in prior art, consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles, and ellipses are included as well, since they can be understood as polygons with a very large (ideally infinite) number of sides. An antenna is said to be a multilevel antenna, when at least a portion of the antenna is shaped as a multilevel structure.

A space-filling curve for a space-filling antenna, as it is known in prior art, is composed by at least ten segments which are connected in such a way that each segment forms an angle with their neighbours, i.e., no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop).

In some particular embodiments of the present invention, the antenna is tuned to operate simultaneously at four bands, those bands being for instance GSM850, GSM900, DCS1800, and PCS1900. In other embodiments the antenna is able to cover also the UMTS band. There is not an example described in the prior art of an antenna of this size covering such a broad range of frequencies and bands.

The combination of said services into a single antenna device provides an advantage in terms of flexibility and functionality of current and future wireless devices. The resulting antenna covers the major current and future wireless services, opening this way a wide range of possibilities in the design of universal, multi-purpose, wireless terminals and devices that can transparently switch or simultaneously operate within all said services. For instance, the simultaneous coverage of the GSM850, GSM900, DCS1800, and PCS1900 provides to a cell phone user with the ability to connect transparently to any of the two existing European GSM bands (GSM900 and DCS1800) and to any of the two American GSM bands (PCS1900 and the future GSM850).

SUMMARY OF THE INVENTION

The key point of the present invention consists of shaping a particular multilevel structure for a multiband antenna, such that said multilevel structure defines a winding gap or spacing between some of the characteristic polygons within said multilevel structure, said gap featuring a substantially similar shape as the overall multilevel structure, that is, similar winding path.

When the multiband behaviour of a multilevel structure is to be packed in a small antenna device, the spacing between the polygons of said multilevel structure is minimized. Drawings 3 and 4 illustrated in FIGS. 1C and 1D are some examples of prior art multilevel structures, where the spacing between conducting polygons (rectangles and squares in these particular cases) take the form of narrow gaps. One of the novelties of the present invention is that the shape of said gap has the same general winding shape as the two multilevel arms of the antenna. This way, the coupling between the arms of the antenna enhances its broadband and multiband behaviour while further reducing the antenna size. Such a configuration allows an effective tuning of the frequency bands of the antenna, such that with the same overall antenna size, said antenna can be effectively tuned simultaneously to some specific services, such as for instance the five frequency bands that cover the services GSM850, GSM900, DCS1800, and PCS1900.

It should be stressed that the present invention can be combined with the new generation of ground-planes described in the PCT application number PCT/EP01/10589 entitled "Multilevel and Space-Filling Ground-Planes for Miniature and Multiband Antennas", which describes a ground-plane for an antenna device, comprising at least two conducting surfaces, said conducting surfaces being connected by at least a conducting strip, said strip being narrower than the width of any of said two conducting surfaces. Although not strictly necessary, for some applications where a further enhancement of the overall bandwidth at each band is required, it is preferred that the portion of the ground-plane that is shaped as a multilevel or space-filling structure is the area placed underneath the so called radiating element, according to the present invention.

When combined to said ground-planes according to the present invention, the combined advantages of the newly disclosed antenna geometry and said ground-plane design are obtained: a compact-size antenna device with an enhanced bandwidth, enhanced frequency behaviour, enhanced VSWR, and enhanced efficiency.

The advantages of the antenna design disclosed in the present invention are:

(a) The antenna size is reduced with respect to other prior-art multilevel and multiband antennas.

(b) The frequency response of the antenna can be tuned to at least four frequency bands that cover the European and American GSM services: GSM850, GSM900, DCS1800, and PCS1900.

Those skilled in the art will notice that the same basic structure can be used to tune the antenna to include other frequency bands such as UMTS, Bluetooth™, and WLAN (such as for instance IEEE802.11 and Hyperlan2). The skilled in the art will also notice that current invention can be applied or combined to many existing prior-art antenna techniques. The new geometry can be, for instance, applied to microstrip patch antennas, to Planar Inverted-F antennas (PIFAs), to monopole antennas, and so on. It is also clear that the same antenna geometry can be combined with several ground-planes and radomes to find applications in different environments: handsets, cellular phones and general handheld devices; portable computers (Palmtops, PDA, Laptops, . . . ), indoor antennas (WLAN, cellular indoor coverage), outdoor antennas for microcells in cellular environments, antennas for cars integrated in rear-view mirrors, stop-lights, bumpers, and so on.

BRIEF DESCRIPTION OF THE DRAWINGS

FIGS. 1A, 1B, 1C, and 1D show several prior-art multilevel structures for antennas devices. All of them are constructed from rectangles. FIGS. 1C and 1D show two particular cases where the spacing between polygons (rectangles) take the form of a narrow gap, which however does not feature a similar shape as the multilevel structure.

In FIG. 3A the antenna is fed through a first strip (121) and shorted to ground through a second strip (120). In FIG. 3B, rectangle (123) enhances the capacitive behavior with ground plane (110). FIG. 3C is same as FIG. 3A, wherein four rectangles are merged into two rectangles (125) and (126).

FIGS. 5A and 5B show two particular embodiments of the present invention. Again, area on (110) underneath first layer (109) is shaped as a multilevel structure according to the present invention.

FIGS. 6A and 6B show same basic design as FIG. 6A, where some minor mechanical changes have been introduced both in first and second layer (109) and (110) to allow the integration of the antenna structure into a typical handset structure.

DETAILED DESCRIPTION OF THE PREFERRED EMBODIMENTS

Figure 2A:
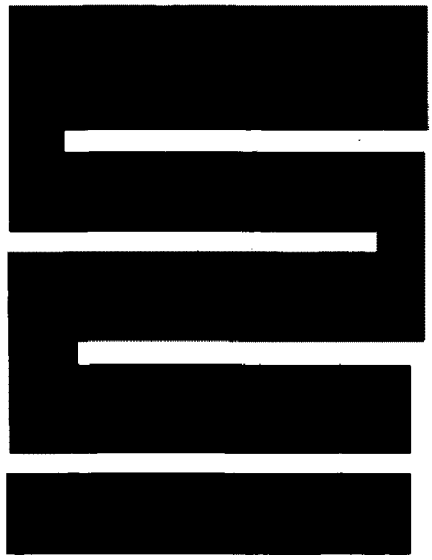
FIGS. 2A and 2B show prior-art multilevel structure formed by 8 rectangles. The gaps between rectangles do not feature a similar shape as the overall multilevel structure.
Figure 2B:
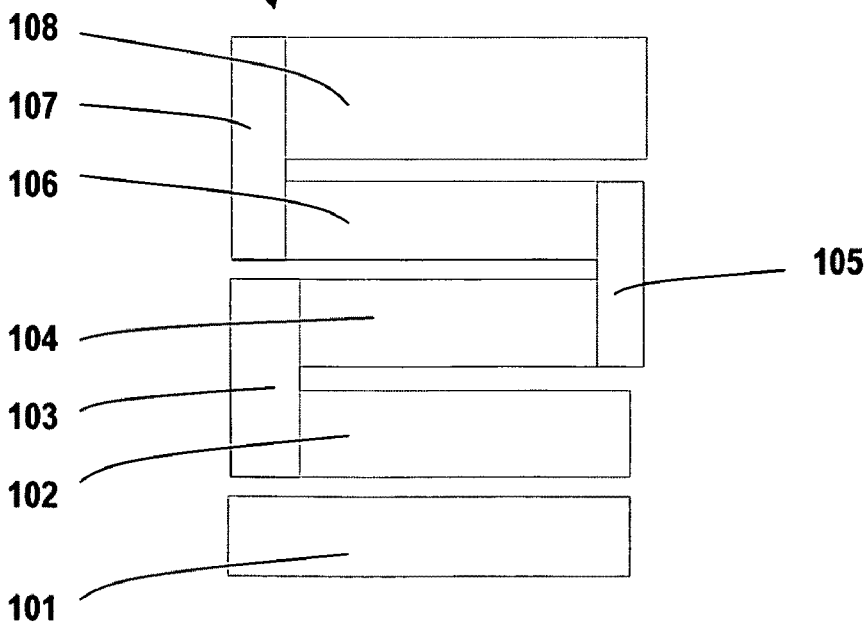
Figure 3A:
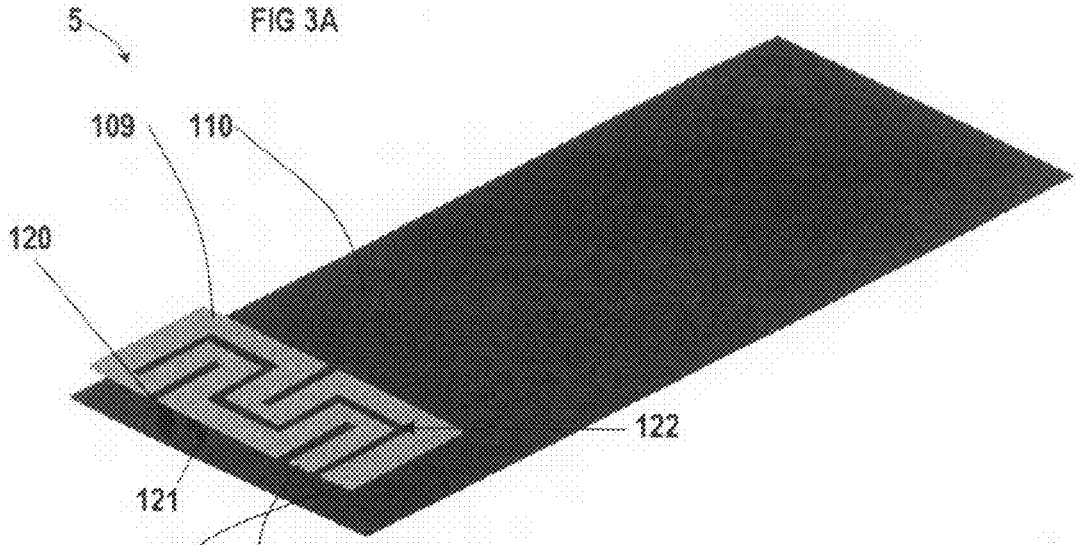
FIGS. 3A, 3B, and 3C show three particular embodiments of the present invention. A first conducting layer (109) is placed over a second conducting layer (110), said second conducting layer acting as a ground-plane or ground counterpoise. Layer (109) takes the form of a multilevel structure, said structure being characterized by two arms (111) and (112), said arms defining a winding path and a gap (122) between said arms, said gap (122) featuring a substantially similar shape as arms (111) and (112).
Figure 7:
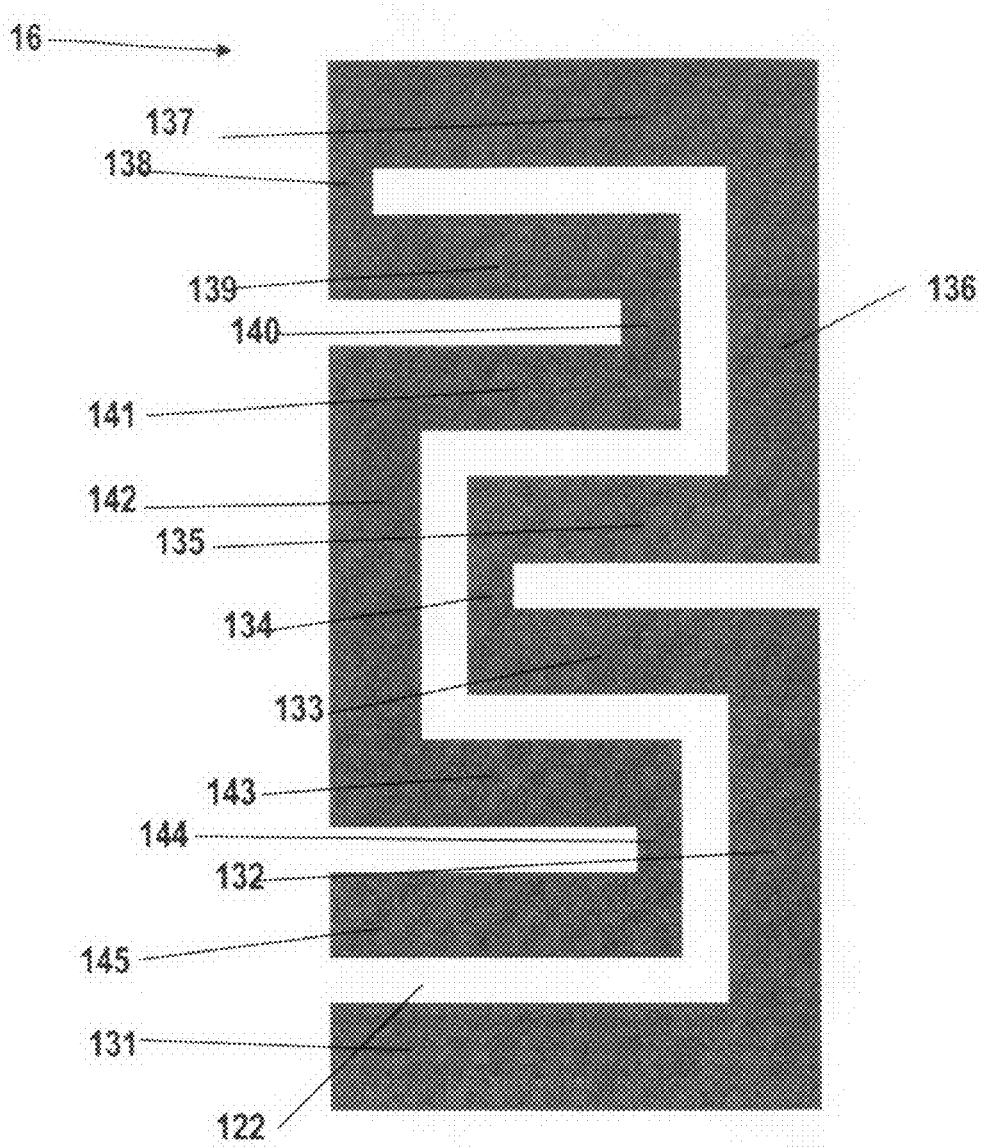
FIG. 7. Shows a particular embodiment for multilevel structure on first layer according to the present invention. This particular multilevel structure is composed by 15 polygons of the same class (from 131, which can be either the starting or ending point, to 145, which can be either the ending or starting point), said polygons defining a gap (122), said gap featuring a substantially similar winding shape as the two coupled arms on said multilevel structure.
Figure 11:
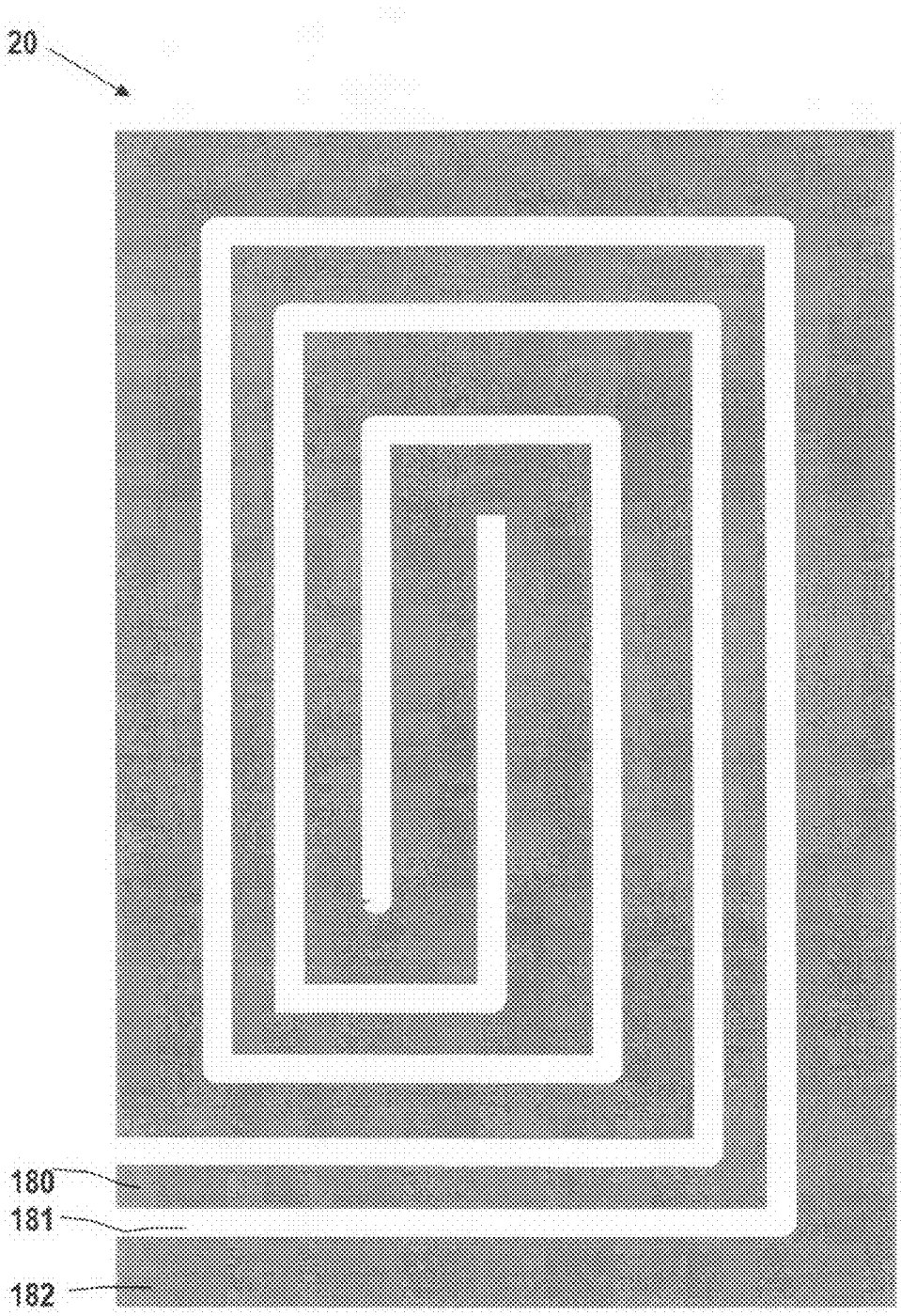
FIG. 11 shows a particular embodiment for multilevel structure on first layer according to the present invention. This particular multilevel structure is composed by 17 polygons of the same class (in this case, rectangles). Rectangle (180) can be either the starting or ending part of the multilevel arm of the formation of the structure, and rectangle (182) can be either the ending or starting part of the multilevel arm. As it can be seen from the drawing, gap (181) features a similar winding shape as the two coupled arms.

Drawing 5 in FIG. 3A shows one particular embodiment of the multilevel structure and the two arms of different length, a longer arm (111) and a shorter arm (112), that follow a winding parallel path spaced by a gap (122) with a substantially similar shape as each of said arms (111, 112). The multilevel structure is based on design from Drawing 16 in FIG. 7 and it includes 15 conducting rectangles: a first rectangle (131) being orthogonally connected at one end to a second rectangle (132), said second rectangle being orthogonally connected at a second tip to a first tip of a third rectangle (133), said third rectangle being orthogonally connected at a second tip to a first tip of a fourth rectangle (134), said fourth rectangle being orthogonally connected at a second tip to a first tip of a fifth rectangle (135), said fifth rectangle, parallel to the third rectangle (133), being orthogonally connected at a second tip to a first tip of a sixth rectangle (136), said sixth rectangle being orthogonally connected at a second tip to a first tip of a seventh rectangle (137), said seventh rectangle being orthogonally connected at a second tip to a first tip of a eighth rectangle (138), said eighth rectangle being orthogonally connected at a second tip to a first tip of a ninth rectangle (139), said ninth rectangle, parallel to the seventh rectangle (137), being orthogonally connected at a second tip to a first tip of a tenth rectangle (140), said tenth rectangle, parallel to the sixth rectangle (136), being orthogonally connected at a second tip to a first tip of a eleventh rectangle (141), said eleventh rectangle, parallel to the ninth rectangle (139), being orthogonally connected at a second tip to a first tip of a twelfth rectangle (142), said twelfth rectangle, parallel to the fourth rectangle (134), being orthogonally connected at a second tip to a first tip of a thirteenth rectangle (143), said thirteenth rectangle, parallel to the third rectangle (133), being orthogonally connected at a second tip to a first tip of a fourteenth rectangle (144), said fourteenth rectangle, parallel to the second rectangle (132), being orthogonally connected at a second tip to a first tip of a fifteenth rectangle (145), being this last rectangle (145) parallel to the first rectangle (131). Rectangles (145, 144, 143, and 142) define the shorter arm (112) of the multilevel structure according to the present invention, while the other eleven rectangles define the longer arm (111). Similar shapes within the scope of this invention could have been used for this purpose, such as the one shown in FIG. 11, Drawing 20. In this Drawing 20, the structure is being composed by 17 rectangles. Two posting elements (120, 121) are connected, one acting as a short-circuit (120) between the antenna element, and the other one (121) acting as the feeding point for the structure. Within the scope of the present invention, and depending on its application, several frequency responses can be achieved by removing the short-circuit posting (120), and having only the feeding point (121). It is clear the that shape of the gap (122) and the two arms (111, 112) can be changed, as well as the position for the two posting elements (120, 121). This would allow a fine tuning of the antenna to the desired frequency bands in case the desired application would request it. Also, it is shown in this particular embodiment that one edge on the perimeter of first layer (109) is substantially aligned with one of the shorter edges of second layer (110), said second layer featuring a substantially elongated rectangular shape, such that the first layer (109) is covering a portion of the tip region of said second conducting layer or ground-plane (110). In some embodiments, such edge is the preferred one to include the feeding element (121) according to the present invention.

Figure 3B:
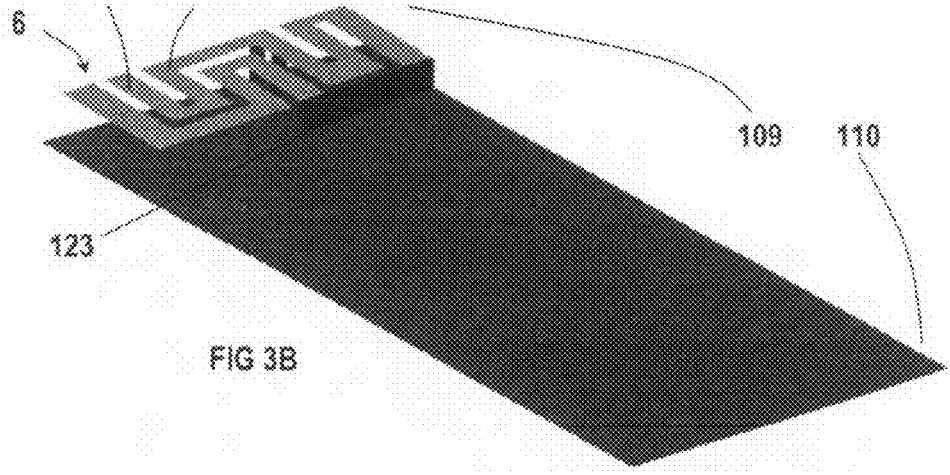

Another preferred embodiment is shown in FIG. 3B, Drawing 6. It shows the same antenna pattern and groundplane configuration than the one described in FIG. 3A, but with the addition of an orthogonally connected piece acting as a loading capacitor (123) to the sixth rectangle. This would allow a fine tuning of the antenna to the desired frequency bands by means of the capacitively effect of said extra piece, which is acting as a loading capacitor (123), with the rest of the structure. Needless to say that the shape of the loading capacitor (123) can be changed, as well as the length, width, and height. Also, depending on the application and the needed frequency response, it can be placed along another rectangle of the structure. Additionally, more than one loading capacitor (123) can be placed on the structure, depending on the application and the required frequency response.

Figure 3C:
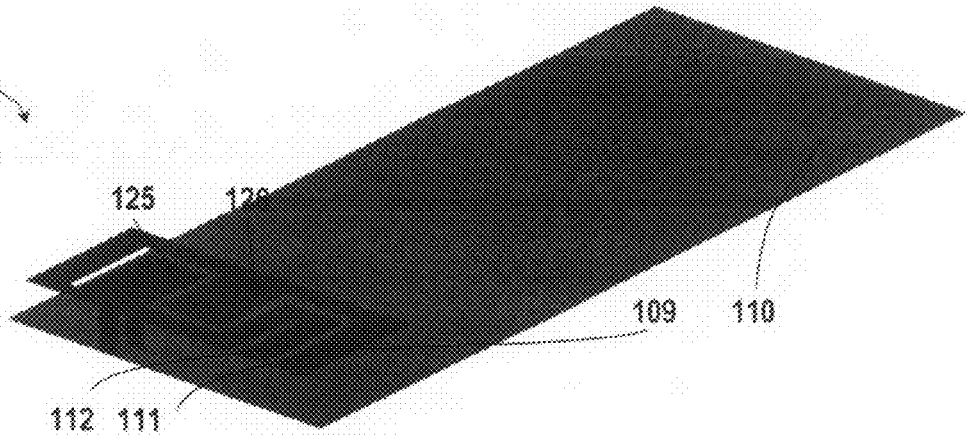

It will be clear to those skilled in the art that the present invention can be combined in a novel way to other configurations, such as the one shown in FIG. 3C Drawing 7. In that antenna pattern, the gap that was between the rectangles (139), (140), (141) has been filled out forming an area (125), as well as the gap between rectangles (133), (134), (135), which has been filled out forming an area (126). It is clear that, within the scope of the present invention, several other parts for the winding gap can be filled out as well, depending on the application and the required frequency bands.

Figure 4A:
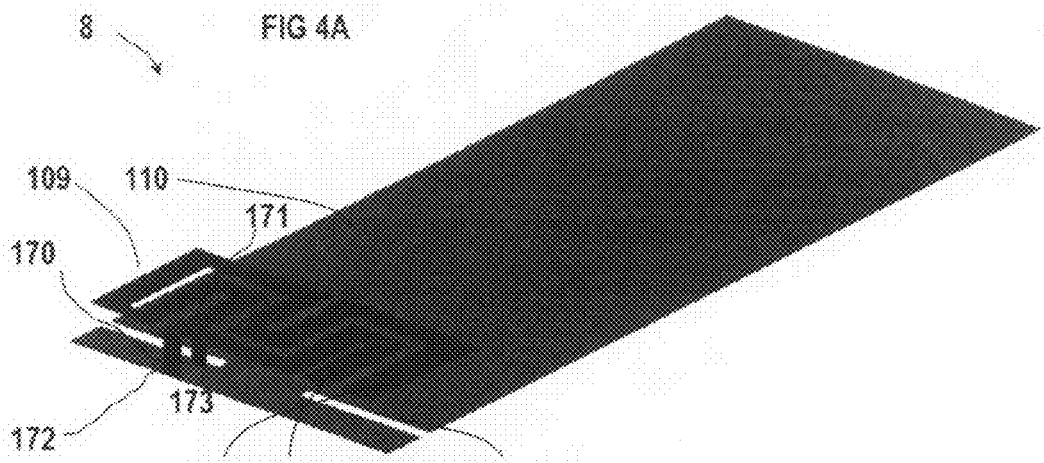
FIGS. 4A, 4B, and 4C show three particular embodiments of multilevel antenna according to the present invention. All three embodiments include a multilevel ground-plane (110). In this three embodiments, the arrangement of polygons in said multilevel ground-plane (110) form a gap (113), (114), said gap being placed on (110) in the area underneath of first layer (109), according to the technique disclosed in the present invention.
Figure 4B:
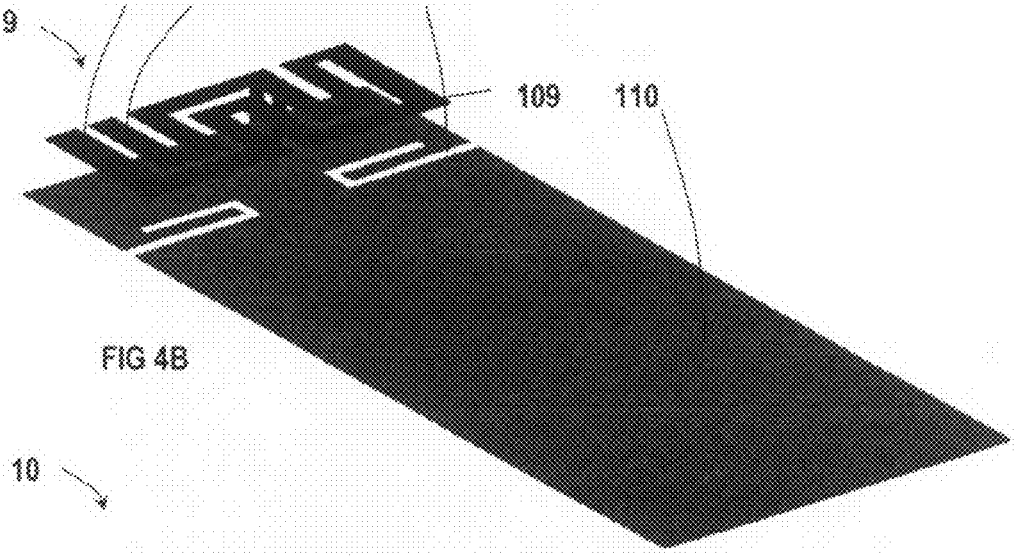
Figure 4C:
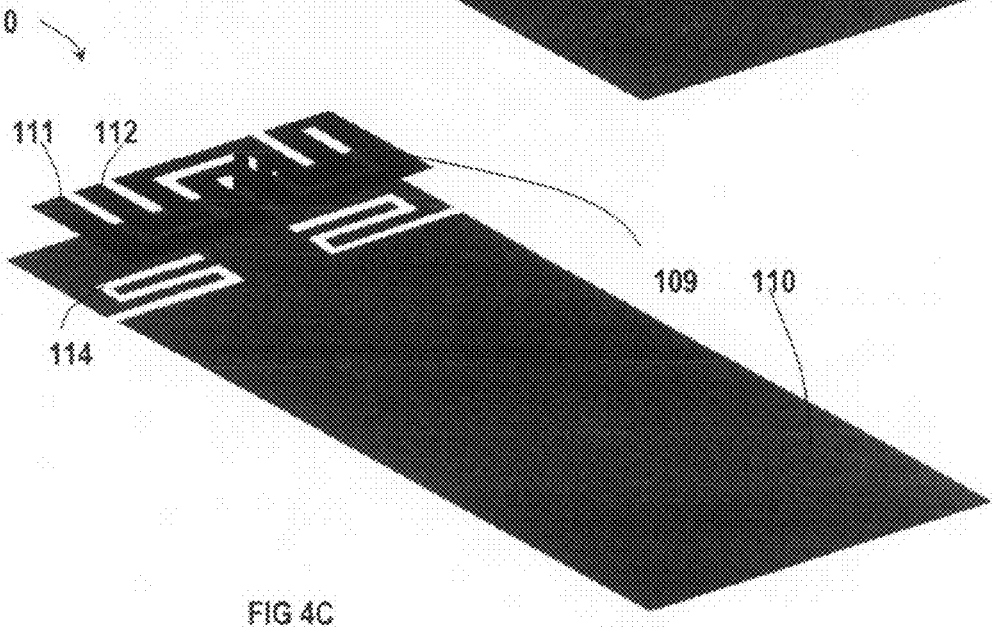

Three other embodiments for the invention are shown in FIGS. 4A, 4B, and 4C. No matter what the final configuration is for the antenna element, the ground-plane can be changed so as to increase the performance of the structure in terms of bandwidth and efficiency. FIGS. 4A, 4B, and 4C show a groundplane (110) characterized in that the portion that is underneath the antenna element or first layer (109) is shaped either as a multilevel structure, a space-filling structure, or a combination of both. According to the present invention, it is preferred that such a portion of ground-plane (110) which includes the gaps defined by the polygons of said multilevel structure does not extend beyond the area underneath the first layer (109) further than a distance equal to twice the maximum distance between said first and second layers (109) and (110) respectively. On the other hand, FIG. 4A is characterized in that besides shorting post (172) between (109) and (110), there is also another interconnection between said first layer (109) and second layer (110) through a conducting wire or strip (173) connected at the feeding point (171) at one tip, located at (109), and at the input port (170) at the other tip, located on (110). In other words, conducting wire (173) includes two ends, (170), located on second layer (110), and (171), located on first layer (109).

In these particular embodiments, shape 113 in groundplane 110 shows a multilevel structure, being composed by two rectangular slots. It is clear that, within the scope of the present invention, several other multilevel and/or space-filling slot shapes could have been placed, depending on the application and the desired frequency band. Just as an example, but without limiting the present invention, FIGS. 4B and 4C show two particular configurations for the groundplane shape (113, 114). Both (113) and (114) are portions that are underneath the antenna and are shaped as a multilevel structures. (113) is being formed by two symmetrical slots cut-out onto the ground-plane, and each slot being composed by three rectangles orthogonally connected at their ends. (114) is being formed by two symmetrical slots cut-out onto the ground-plane, and each slot being composed by five rectangles orthogonally connected at their ends.

Drawing 11 from FIG. 5A shows a groundplane (110) shape underneath the antenna being formed by two symmetrical slots (115) and (115') cut-out onto the ground-plane, and each slot (115) and (115') being composed by seven rectangles, that is, composed by a multilevel shape, orthogonally connected at their ends. The two multilevel symmetrical slots (115) and (115') enhance the antenna device in terms of size, VSWR, bandwidth, and/or efficiency.

It is clear to those skilled in the art that the present invention covers a whole new set of multilevel and/or space-filling structures for the ground-plane underneath the antenna. For instance, in the embodiment shown in Drawing 12 from FIG.

5B, the shape (116) for the ground-plane (110) underneath the antenna is being composed by six rectangles, three at each side symmetrically located.

It will be clear to those skilled in the art that the present invention can be combined in a novel way to other prior-art antenna configurations. For instance, the new generation of ground-plane shapes underneath the antenna can be used in combination with prior-art antennas to further enhance the antenna device in terms of size, VSWR, bandwidth, and/or efficiency.

Figure 6A:
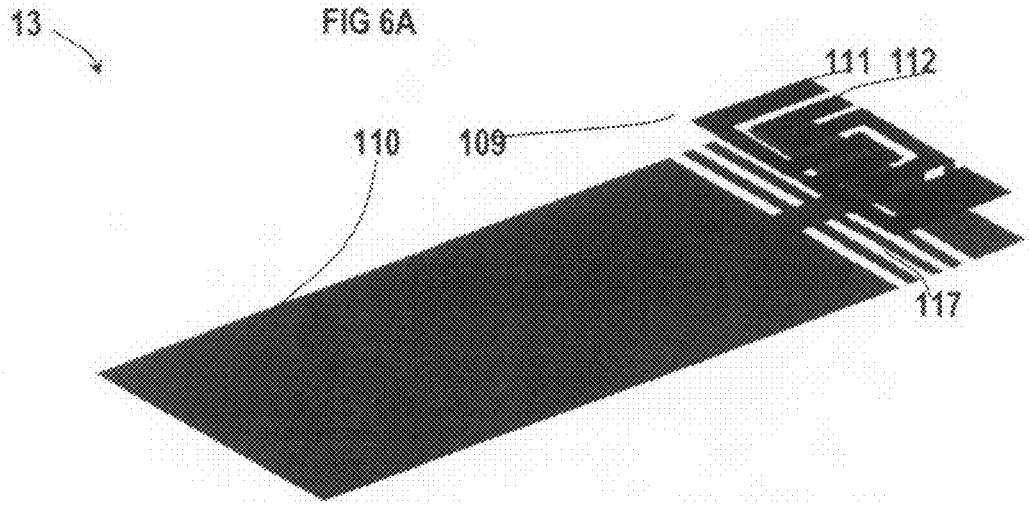
FIGS. 6A, 6B, and 6C show three particular embodiments of the present invention. Again, area on (110) underneath first layer (109) is shaped as a multilevel structure according to the present invention, where said multilevel structure is arranged such that the gaps between polygons take the form of eight gaps, four at each side of an axially arranged central polygon.
Figure 6B:
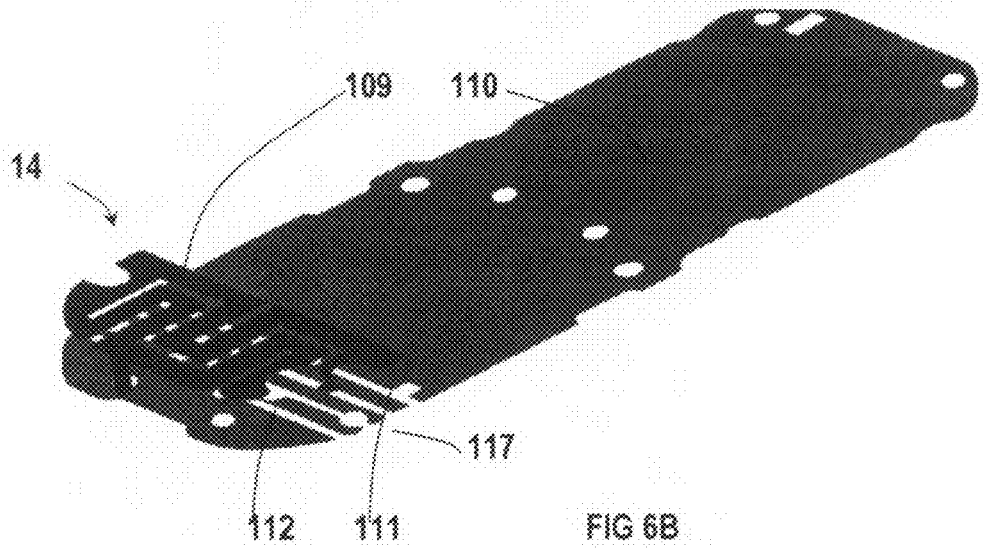
Figure 6C:
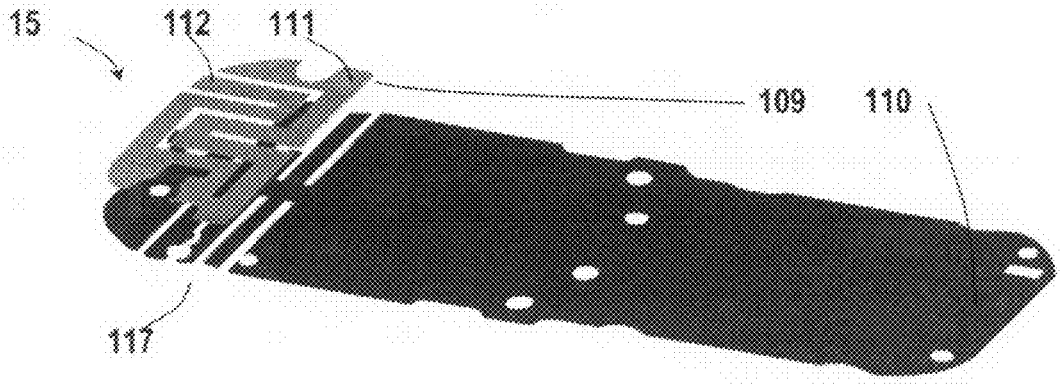
Figure 8:
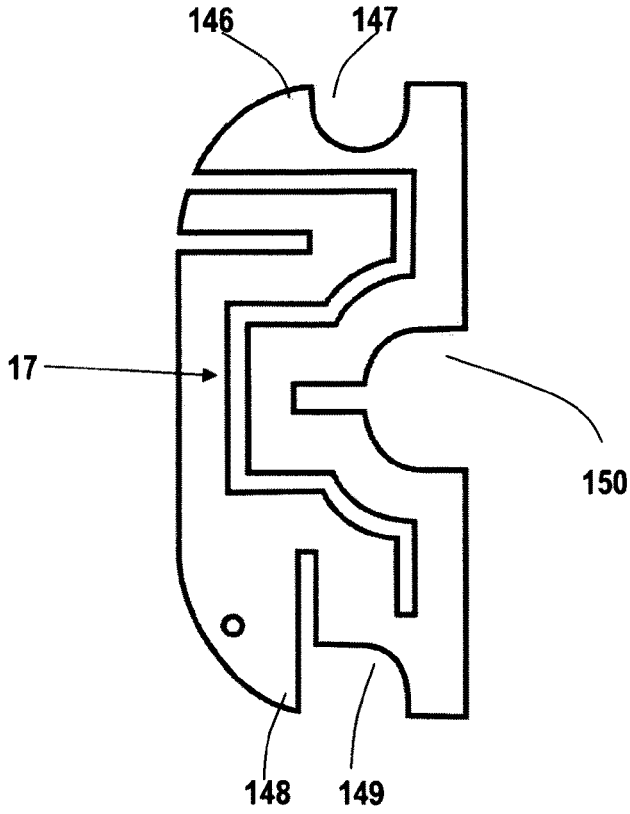
FIG. 8 shows another preferred embodiment of a multilevel structure for the first layer (109) according to the present invention. In this arrangement, some edges in the polygons defining said multilevel structure are replaced by curves (146, 147, 148, 149, 150) to ease the mechanical integration of the antenna in the handheld device. A feeding point (158) could be seen on the first layer (109).
Figure 9:
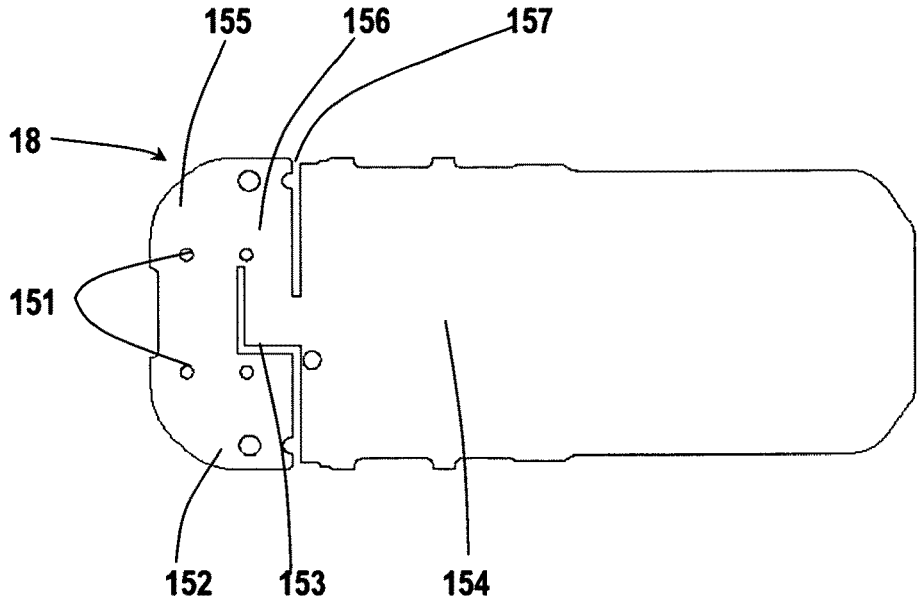
FIG. 9. Shows a particular embodiment of a ground-plane (second layer 110) according to the present invention. The area underneath (109) is shaped as a multilevel structure with 4 polygons (154, 152, 155, 156), said polygons defining two gaps (157) and (153). To ease the integration within the mechanical structure of typical handheld device, minor changes on the geometry are introduced which do not have a substantial effect on the essential electromagnetic behavior of the invention. For instance, some insets are done on the perimeter of larger rectangle (154), while two straight edges on polygons (155) and (152) are replaced by curved segments. Also, some small holes such as (151) are distributed upon ground-plane. Said holes are made for mechanical or acoustic reasons and do not affect the general behavior of the invention.
Figure 10:
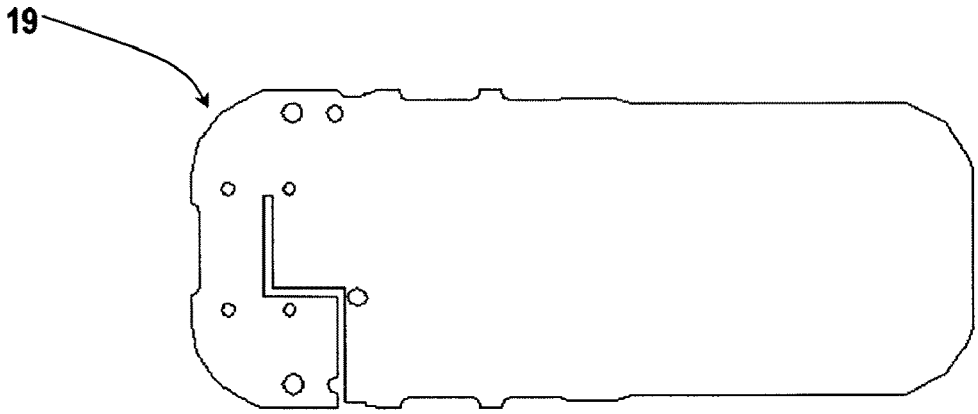
FIG. 10 is same as drawing 18 with a slightly different arrangement of polygons on layer (110) such that gap (157) is not included.

Other preferred embodiments are shown in Drawings 14 and 15 in FIGS. 6B and 6C. In those, it is shown that the shape of the antenna elements or first layer (109) can be matched to fit inside the external cover for a particular wireless application. First layer (109) in both FIGS. 6B and 6C has a size of 38.times.16.5.times.5.5 mm, and the antenna structure is substantially matched at the frequency bands 824 MHz-960 MHz and 1710 MHz-2170 MHz. For both drawings, the shape (117) for the ground-plane (110) underneath the antenna element or first layer (109) has been matched to fit some external components included on the wireless terminals, such as screws, boses, or plastic pieces. Also, some edges of the rectangles composing multilevel structures that is first and second layers (109) and (110) have been replaced by curved segments to ease the mechanical integration of the invention in a typical handheld device. Also, some small holes are placed on (110) to allow screws and other mechanical fixtures to be included in the integration process. It will be clear to those skilled in the art, that those are minor changes on the mechanical configuration that do not play a substantial effect on the essential electromagnetic behavior of the invention, and therefore are included within the scope and spirit of the present invention. Other examples of variations that are included within the scope and spirit of the present invention are shown, without any limiting purpose in FIG. 8, FIG. 9 and FIG. 10. In particular, FIG. 10 shows an embodiment 19 wherein the multilevel structure in (110) defines a single slot on the ground-plane (110), while in FIG. 9 said multilevel structure defines at least two slots (as in the case in the embodiment of drawing 8). Although not necessary, it is preferred that at least one of the slots defined by said multilevel structure on second layer (110) is substantially aligned with one of the edges of the outer perimeter enclosing first layer (109).

It is important to stress that the key aspect of the invention is the geometry disclosed in the present invention. The manufacturing process or material for the antenna device is not a relevant part of the invention and any process or material described in the prior-art can be used within the scope and spirit of the present invention. To name some possible examples, but not limited to them, the antenna could be stamped in a metal foil or laminate; even the whole antenna structure including the multilevel structure, loading elements and ground-plane could be stamped, etched or laser cut in a single metallic surface and folded over the short-circuits to obtain, for instance, the configurations in FIGS. 3A-C, 4A-C, 5A-B, and 6A-C. Also, for instance, the multilevel and/or space-filling structure on the ground-plane might be printed over a dielectric material (for instance FR4, Rogers®, Arlon® or Cuclad®) using conventional printing circuit techniques, or could even be deposited over a dielectric support using a two-shot injecting process to shape both the dielectric support and the conducting multilevel and/or space-filling structure.

The invention claimed is:

1. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm, such that a gap between said first shorter arm and said second longer arm is formed;

said gap following substantially the same winding path as said first and second arms on said multilevel structure; and wherein said at least one multilevel structure comprises a conducting structure including a set of polygons, all of said polygons featuring the same number of sides, wherein said polygons are electromagnetically coupled either by means of a capacitive coupling or ohmic contact, wherein a contact region between directly connected polygons is narrower than 50% of a perimeter of said polygons in at least 75% of said polygons defining said conducting multilevel structure.

2. The multiband antenna according to claim 1, wherein the only interconnection between said first conducting layer and said second conducting layer is through a conducting wire or strip connected at the feeding point at one tip, located on said first conducting layer, and at an input port at another tip, located on said second conducting layer.

3. The multiband antenna according to claim 1, wherein said second conducting layer acting as said ground plane has a substantially rectangular or elongated shape, wherein said first conducting layer has at least one edge substantially aligned together with at least one shorter edge of said second conducting layer such that said first conducting layer is covering a portion of a tip region over said second conducting layer.

4. The multiband antenna according to claim 3, wherein at least a portion of an area on said second conducting layer is extended beyond an area underneath said first conducting layer up to at most a distance equal twice a maximum distance between said first and second conducting layers.

5. The multiband antenna according to claim 4, wherein said feeding point is connected to an input port located on said second conducting layer by means of a conducting wire or strip, said feeding point being placed at an edge of the first conducting layer which is substantially aligned with the shorter edge of said second conducting layer.

6. The multiband antenna according to claim 1, wherein a frequency response of the antenna is tuned to at least five frequency bands.

7. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm such that a gap between said first shorter arm and said second longer arm is formed, said gap following substantially the same winding path as said first and second arms on said multilevel structure;

wherein at least a portion of an area on the second conducting layer which is underneath said first conducting layer is shaped as a multilevel structure or a space-filling structure or a combination of both; and wherein said at least one multilevel structure comprises a conducting structure including a set of polygons, all of said polygons featuring the same number of sides, wherein said polygons are electromagnetically coupled either by means of a capacitive coupling or ohmic contact, wherein a contact region between directly connected polygons is narrower than 50% of a perimeter of said polygons in at least 75% of said polygons defining said conducting multilevel structure.

8. The multiband antenna according to claim 7, wherein said first conducting layer and second conducting layer are interconnected by at least a wire or conducting strip, said wire or conducting strip substantially acts as a short-circuit or low impedance current path between said first and second conducting layers.

9. The multiband antenna according to claim 7, wherein a volume between said first conducting layer and said second conducting layer is smaller than $38\times16.5\times7.5$ $mm^3$ and the antenna is substantially matched at frequency bands 824 MHz-960 MHz and 1710 MHz-2170 MHz.

10. The multiband antenna according to claim 7, wherein said second conducting layer is one of the layers of a printed circuit board in a handheld wireless terminal such as a cellular phone, a wireless phone, a personal digital agenda (PDA), or a palmtop computer.

11. The multiband antenna according to claim 7, wherein a frequency response of the antenna is tuned to at least four frequency bands.

12. The multiband antenna according to claim 7, wherein said multiband antenna comprises at least a piece acting as a loading capacitor which is orthogonally connected to at least one rectangle of the multilevel structure.

13. The multiband antenna according to claim 7, wherein a frequency response of the antenna is tuned to at least five frequency bands.

14. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm, such that a gap between said first shorter arm and said second longer arm is formed;

said gap following substantially the same winding path as said first and second arms on said multilevel structure;

wherein said first shorter arm is composed by at least four rectangles, said four rectangles being sequentially interconnected through their shorter edges; and wherein said second longer arm is composed at least by eleven rectangles, said eleven rectangles being sequentially interconnected through their shorter edges, wherein said both arms define said winding path over said second conducting layer, wherein said second longer arm is folded upon itself to run in parallel with the winding path of said first shorter arm such that a gap between both arms is formed, said gap following substantially similar winding path to those of said first and second arms.

15. The multiband antenna according to claim 6, wherein at least one of the edges composing the multilevel structure in said first conducting layer is replaced by at least a curve.

16. The multiband antenna, according to claim 15, wherein said multilevel structure in said second conducting layer is composed by at least three rectangles, a first rectangle being substantially aligned along a central axis upon said second conducting layer or said ground-plane, said first rectangle being connected through one of its shorter edges to said ground-plane, a second of said rectangles being connected to a first longer edge of said first rectangle, a third of said rectangles being connected to the second longer edge of said first rectangle.

17. The multiband antenna according to claim 16, wherein said multilevel structure in said second layer is composed by seven rectangles, a first rectangle of said seven rectangles is interconnected by means of its two shorter edges and two disjointed solid conducting areas of said second conducting layer or ground-plane, wherein a second, third and fourth of said seven rectangles are substantially parallel to each other and are connected by one of their tips to the first longer edge of said first rectangle, wherein a fifth, sixth and seventh of said seven rectangles are connected by one of their tips to the second longer edge of said first rectangle, such that the spacing between said rectangles and between said rectangles and the two disjointed solid conducting areas on layer two define eight parallel air or dielectric gaps.

18. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm such that a gap between said first shorter arm and said second longer arm is formed, said gap following substantially the same winding path as said first and second arms on said multilevel structure;

wherein at least a portion of an area on the second conducting layer which is underneath said first conducting layer is shaped as a multilevel structure or a space-filling structure or a combination of both; and wherein said multilevel or space-filling structure on said second conducting layer defines a single slot on said ground-plane.

19. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm such that a gap between said first shorter arm and said second longer arm is formed, said gap following substantially the same winding path as said first and second arms on said multilevel structure;

wherein at least a portion of an area on the second conducting layer which is underneath said first conducting layer is shaped as a multilevel structure or a space-filling structure or a combination of both; and wherein said multilevel or space-filling structure on said second conducting layer defines at least two slots on said ground-plane.

20. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm such that a gap between said first shorter arm and said second longer arm is formed, said gap following substantially the same winding path as said first and second arms on said multilevel structure;

wherein at least a portion of an area on the second conducting layer which is underneath said first conducting layer is shaped as a multilevel structure or a space-filling structure or a combination of both; and wherein said multilevel or space-filling structure on said second conducting layer defines at least a slot on said ground-plane, said slot being substantially aligned underneath one edge of said first conducting layer.

21. A multiband antenna comprising:

a first conducting layer;

a second conducting layer;

said first conducting layer acting as a radiating element being placed over said second conducting layer;

said second conducting layer acting as a ground plane;

said first conducting layer comprises a feeding point, wherein said feeding point is a starting point for a first shorter arm and a second longer arm, said first and second arms forming a multilevel structure for said multiband antenna;

wherein said first and second arms define a winding path, wherein said second longer arm is folded upon itself to run in parallel with the winding path of said first shorter arm such that a gap between said first shorter arm and said second longer arm is formed, said gap following substantially the same winding path as said first and second arms on said multilevel structure;

wherein at least a portion of an area on the second conducting layer which is underneath said first conducting layer is shaped as a multilevel structure or a space-filling structure or a combination of both; and wherein said at least one space-filling structure comprises a curve comprising at least ten segments which are connected in such a way that each segment forms an angle with their neighbours, wherein no pair of adjacent segments define a larger straight segment, and wherein the curve can be optionally periodic along a fixed straight direction of space if the period is defined by a non-periodic curve composed by at least ten connected segments and no pair of said adjacent and connected segments define a straight longer segment.

* * * * *